United States Patent [19]

Clapper

[11] 4,119,519

[45] Oct. 10, 1978

[54] BIPOLAR ELECTRODE FOR USE IN AN ELECTROLYTIC CELL

[75] Inventor: Thomas W. Clapper, Oklahoma City, Okla.

[73] Assignee: Kerr-McGee Corporation, Oklahoma City, Okla.

[21] Appl. No.: 784,343

[22] Filed: Apr. 4, 1977

[51] Int. Cl.[2] ..... C25B 9/00; C25B 11/02; C25B 11/10

[52] U.S. Cl. ..... 204/268; 204/289; 204/290 F

[58] Field of Search ..... 204/280, 289, 290 F, 204/268, 254, 256

[56] References Cited

U.S. PATENT DOCUMENTS

| | | | |
|---|---|---|---|
| 3,441,495 | 4/1969 | Colman | 204/268 |
| 3,873,437 | 3/1975 | Pulver | 204/280 X |
| 4,017,375 | 4/1977 | Pohto | 204/268 X |
| 4,055,291 | 10/1977 | Peters | 204/256 X |
| 4,059,216 | 11/1977 | Meyer | 204/256 X |

*Primary Examiner*—John H. Mack
*Assistant Examiner*—D. R. Valentine
*Attorney, Agent, or Firm*—William G. Addison

[57] ABSTRACT

An improved bipolar electrode having an anodic member and a cathodic member connected in an assembled position spaced a distance apart with a connector constructed of an electrically conductive material disposed between and engaging portions of the anodic member and the cathodic member, the connector mechanically supporting the anodic and the cathodic members in a spaced apart relationship and establishing electrical continuity therebetween.

20 Claims, 14 Drawing Figures

BIPOLAR ELECTRODE FOR USE IN AN ELECTROLYTIC CELL

CROSS-REFERENCE TO RELATED APPLICATIONS

Related subject matter is disclosed in the patent application, Ser. No. 545,016, entitled "A HYBRID BIPOLAR ELECTRODE", filed on Jan. 29, 1975, now U.S. Pat. No. 4,085,027, and assigned to the same assignee as the present invention. Also, related subject matter is disclosed in the patent application, Ser. No. 545,015, entitled "A BIPOLAR ELECTRODE AND METHOD FOR CONSTRUCTING SAME", filed on Jan. 29, 1975, now U.S. Pat. No. 4,069,130, and assigned to the same assignee as the present invention.

BACKGROUND OF THE INVENTION

1. Field of the Invention

The present invention relates generally to an improved bipolar electrode and, more particularly, but not by way of limitation, to an improved bipolar electrode having an anodic member and a cathodic member connected in a spaced apart relationship.

2. Brief Description of the Prior Art

In the past, many electrolytic cells have been proposed for use in a variety of applications. Various electrodes for use in electrolytic cell applications have also been proposed in the past.

One type of electrolytic cell included an anode electrode and a cathode electrode immersed in an electrolyte and an electrical power source connected to the anode electrode and the cathode electrode, the positive side of the power source being connected to the anode electrode and the negative side of the power source being connected to the cathode electrode. In this type of electrolytic cell, the electrode functioning as the anode and the electrode functioning as the cathode were generally referred to in the art as "monopolar" electrodes, i.e. each electrode functions as either an anode or a cathode during electrolysis.

Another type of electrolytic cell included an anode electrode and a cathode electrode and at least one electrode interposed between the anode and the cathode electrodes, each of the electrodes interposed between the anode and the cathode electrodes having an anodic member and a cathodic member and being referred to in the art as "bipolar" electrodes. The cathodic member and the anodic member of each bipolar electrode were mechanically connected, and the cathodic member of each of the bipolar electrodes was electrically in series with the anodic members prior and subsequent thereto, i.e. the current flowed through the electrolyte to the cathodic member of the bipolar electrode, through the bipolar electrode and from the anodic member of the bipolar electrode through the electrolyte to the next cathodic member of another bipolar electrode or to the cathodic member of the cathode electrode depending on the number of bipolar electrodes in the electrolytic cell.

In the past, electrodes constructed of a carbon material have been used in the construction of both monopolar electrodes and bipolar electrodes. In some instances, the anodic surfaces were constructed of a carbon material and the cathodic surfaces were constructed of a ferrous material, this type of construction tending to minimize contamination of the electrolyte which results from the electrolytic erosion of many non-carbon anodes.

Bipolar electrodes have been constructed of graphite and, in these instances, the graphite was continuously consumed during electrolysis as a result of oxidation of the graphite surfaces. As the graphite bipolar electrode was consumed, the voltage drop across the electrolytic cell was increased and the temperature of the electrolyte increased with the result being the establishment of an operating temperature range of approximately 25° C. to approximately 70° C. At the upper limit of this operating temperature range, the loss of graphite as a result of graphite oxidation was substantially increased and, in some instances, cooling coils were included in the electrolytic cell to cool the electrolyte in an attempt to maintain the electrolyte temperature at a reduced level (approximately 50° C., for example).

The erosion of the carbon bipolar electrodes caused dimensional instability and resulted in a decreased current efficiency as the carbon bipolar electrode was operated over a period of time. Since the erosion of the carbon bipolar electrodes was not uniform, current density gradients were formed which caused further deleterious effects on the operational characteristics of the electrolytic cell.

In recent years, metal electrodes have been proposed to be operated as anodes in bipolar electrolytic cells, such bipolar electrodes also including a cathodic surface. For example, anodic surfaces of titanium have been proposed with cathodic surfaces bonded thereto and such bipolar electrodes have been proposed for use in chloride brines. A non-conductive film tends to form on exposed titanium anodic surfaces in chloride brines; however, this non-conductive film does not tend to develop on precious metals, such as platinum, for example, and platinum coated titanium anodic surfaces have been utilized in chlor-alkali electrolytic cell applications.

In the past, metal bipolar electrodes have been constructed of precious metal coated titanium sheets bonded to steel plates, the precious metal coated titanium sheets forming the anodic member and the steel plate forming the cathodic member. One problem encountered with such bi-metal bipolar electrodes was that the precious metal coated titanium sheet was deformed via the action of molecular hydrogen migrating through the cathodic member to the anodic member forming an expanded hydride with the titanium. This action resulted in a weakening of the structural integrity of the bond between the precious metal coated titanium sheet and the steel plate and, in many instances, resulted in a separation of the titanium-steel along the bonded surface.

BRIEF DESCRIPTION OF THE DRAWINGS

FIG. 6 is a sectional view showing the bipolar electrode of FIGS. 1, 2, 3, 4 and 5 disposed in an electrolytic cell.

DESCRIPTION OF THE PREFERRED EMBODIMENTS

Figure 1:
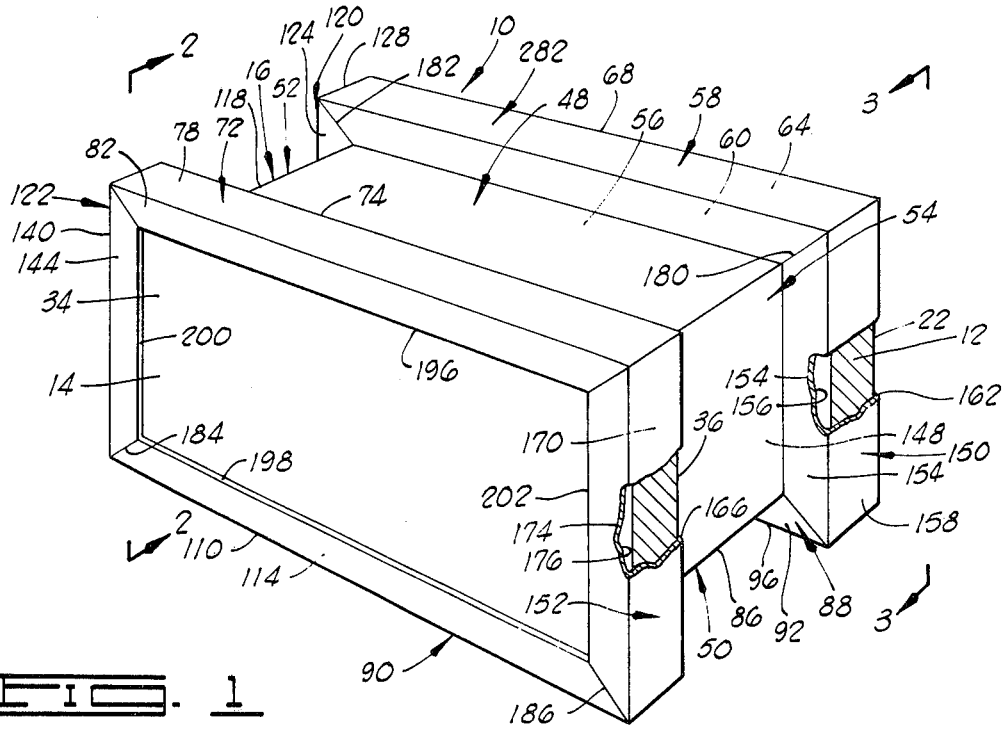
FIG. 1 is a perspective view of a bipolar electrode constructed in accordance with the present invention.
Figure 2:
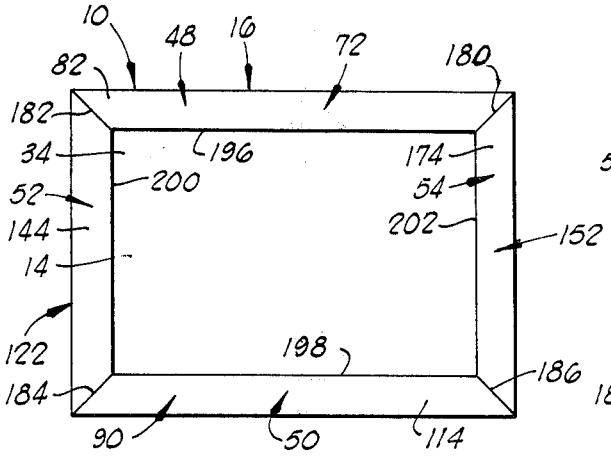
FIG. 2 is a view of the bipolar electrode of FIG. 1, taken substantially along the lines 2—2 of FIG. 1.
Figure 3:
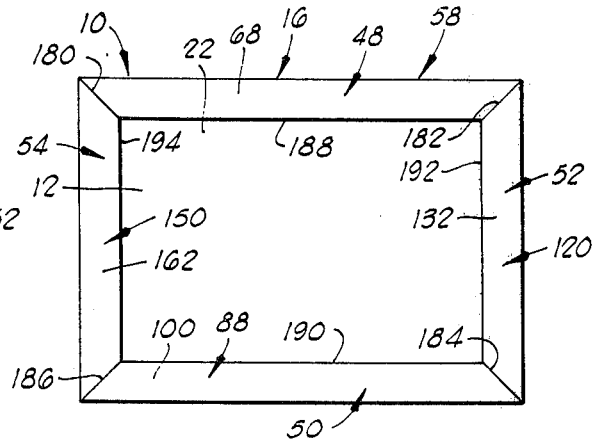
FIG. 3 is a view of the bipolar electrode of FIG. 1, taken substantially along the lines 3—3 of FIG. 1.

Referring to the drawings and to FIGS. 1 through 9, shown therein and designated via the general reference numeral 10 is a bipolar electrode constructed in accordance with the present invention. In general, the bipolar electrode includes an anodic member 12, a cathodic member 14 and a connector 16 having one portion engaging a portion of the anodic member 12, one other portion engaging a portion of the cathodic member 14 and another portion extending between the anodic and the cathodic members 12 and 14. The anodic member 12 is spaced a distance from the cathodic member 14, as shown more clearly in FIGS. 6, 7 and 9, thereby defining a space 18 (shown in FIGS. 6 and 7) between the anodic member 12 and the cathodic member 14 which is substantially sealed from electrolyte. A substantial portion of the connector 16 is constructed of an electrically conductive material and connector 16 establishes electrical continuity between the anodic member 12 and the cathodic member 14.

Figure 7:
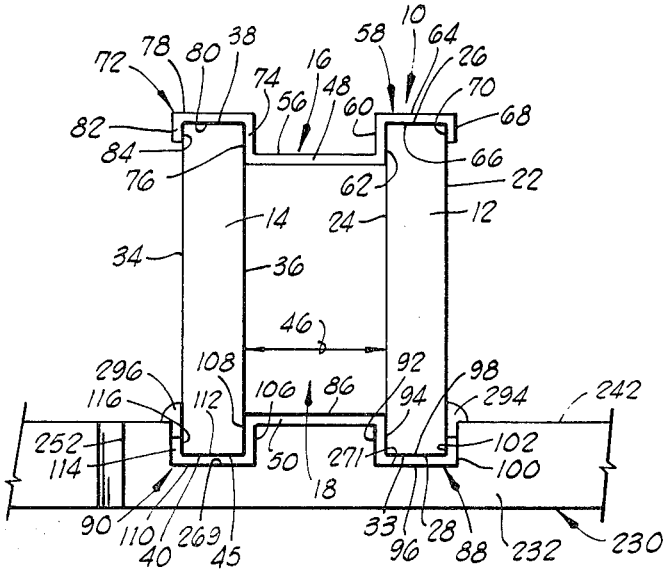
FIG. 7 is a sectional view, taken substantially along the lines 7—7 of FIG. 6.

As shown more clearly in FIGS. 6 and 7, the anodic member 12 is generally rectangularly shaped and has a first face 22, a second face 24, a first side 26, a second side 28, a first end 30 and a second end 32. The sides 26 and 28, and the ends 30 and 32 define an outer peripheral surface 33 of the anodic member 12. The anodic member 12 is constructed such that the first face 22 of the anodic member 12 operates as an anodic surface in an electrolytic cell. In one preferred embodiment, the bipolar electrode 10 is utilized in an alkali metal chlorate or chlorine electrolytic cell for the electrolysis of aqueous solutions of alkali metal chlorides and, in this one preferred embodiment, the anodic member 12 is constructed of a titanium metal sheet having a coating of a noble metal or oxide thereof on the first face 22, such as platinum-iridium, platinum, rubidium, ruthenium, osmium and oxides and the like, for example, the coating being electrically conductive and forming the anodic surface on the anodic member 12 (the coating forming the anodic surface not being separately illustrated in the drawings).

The cathodic member 14 is generally rectangularly shaped and has a first face 34, a second face 36, a first side 38, a second side 40, a first end 42 and a second end 44, as shown more clearly in FIGS. 6 and 7. The sides 38 and 40, and the ends 42 and 44 define an outer peripheral surface 45. The cathodic member 14 is constructed such that the first face 34 of the cathodic member 14 operates as a cathodic surface in an electrolytic cell. In one preferred embodiment, the bipolar electrode 10 is utilized in an alkali metal chlorate or chlorine electrolyte cell for the electrolysis of aqueous solutions of alkali metal chlorides in a manner mentioned before with respect to the anodic member 12 and, in this one preferred embodiment, the cathodic member 14 is constructed of a carbon steel, stainless steel, or other ferrous materials or non-ferrous materials such as copper, nickle or molybdium, for example, serviceable in chlorate solutions.

In an assembled position of the bipolar electrode 10, as shown in FIGS. 6 and 7, the second face 24 of the anodic member 12 is spaced a distance 46 from the second face 36 of the cathodic member 14, and the connector 16 extends between the anodic member 12 and the cathodic member 14, a portion of the connector 16 engaging a portion of the second face 24 of the anodic member 12 and a portion of the connector 16 engaging a portion of the second face 36 of the cathodic member 14. The connector 16 supports the anodic member 12 in a spaced apart relationship with respect to the cathodic member 14 for inhibiting the migration of hydrogen from the cathodic member 14 to the anodic member 12 and substantially reducing titanium hydride embrittlement or the formation of titanium hydride and the resulting deterioration of the titanium anodic member 12 when the bipolar electrode 10 is utilized in an alkali metal chlorate or chlorine electrolytic cell type of application.

In one form, the connector 16 includes a first connector element 48 (shown in FIGS. 1, 2, 3, 4 and 7), a second connector element 50 (shown in FIGS. 1, 2, 3, 4 and 7), a third connector element 52 (shown in FIGS. 1, 2, 3, 5 and 6) and a fourth connector element 54 (shown in FIGS. 1, 2, 3, 5 and 6).

Figure 4:
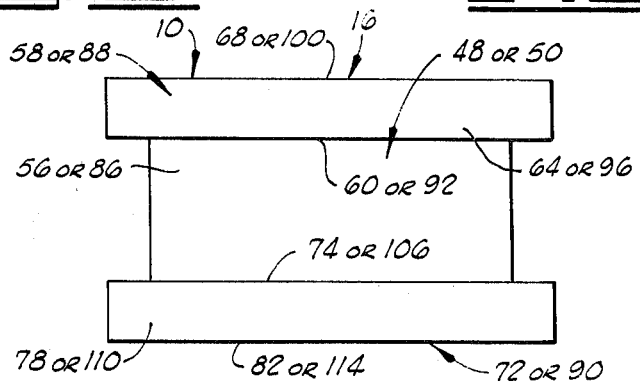
FIG. 4 is a typical first or second side elevational view of the bipolar electrode of FIGS. 1, 2 and 3.

As shown in FIGS. 1, 4 and 7, the first connector element 48 includes a base 56 extending between the second face 24 of the anodic member 12 and the second face 36 of the cathodic member 14. A first flange 58, having a generally U-shaped cross-section, is formed on one side of the base 56. The first flange 58 is disposed about the first side 26 of the anodic member 12 and includes: a first leg 60 extending a distance generally perpendicularly from the base 56 and providing a surface 62 (shown in FIG. 7) disposed generally adjacent a portion of the second face 24 of the anodic member 12; a cross member 64 extending a distance generally perpendicularly from the first leg 60 and disposed in a plane generally parallel with the planar disposition of the base 56, the cross member 64 providing a surface 66 (shown in FIG. 7) disposed generally adjacent the first side 26 of the anodic member 12; and a second leg 68 extending a distance generally perpendicularly from the cross member 64 and disposed in a plane generally parallel with the planar disposition of the first leg 60, the second leg 68 providing a surface 70 (shown in FIG. 7) disposed generally adjacent a portion of the first face 22 of the anodic member 12.

As shown in FIGS. 1, 4 and 7, a second flange 72, having a generally U-shaped cross-section, is formed on the side of the base 56, generally opposite the side having the first flange 58 formed thereon. The second flange 72 includes: a first leg 74 extending a distance generally perpendicularly from the base 56 and providing a surface 76 (shown in FIG. 7) disposed generally adjacent a portion of the second face 36 of the cathodic member 14; a cross member 78 extending a distance generally perpendicularly from the first leg 74 and disposed in a plane generally parallel with the planar disposition of the base 56, the cross member 78 providing a surface 80 (shown in FIG. 7) disposed generally adjacent the first side 38 of the cathodic member 14; and a second leg 82 extending a distance generally perpendicularly from the cross member 78 and disposed in a plane generally parallel with the planar disposition of the first leg 74, the second leg 82 providing a surface 84 (shown in FIG. 7) disposed generally adjacent a portion of the first face 34 of the cathodic member 14.

As shown more clearly in FIGS. 1, 4 and 7, the second connector element 50 is constructed in a manner similar to the first connector element 48, and the second connector element 50 includes: a base 86 extending between the second face 24 of the anodic member 12 and the second face 36 of the cathodic member 14, a first flange 88 formed on one side of the base 86, and a second flange 90 formed on the opposite side of the base 86.

The first flange 88 has a generally U-shaped crosssection and is disposed about the second side 28 of the anodic member 12. The first flange 88 includes: a first leg 92 extending a distance generally perpendicularly from the base 86 and providing a surface 94 (shown in FIG. 7) disposed generally adjacent a portion of the second face 24 of the anodic member 12; a cross member 96 extending a distance generally perpendicularly from the first leg 92 and disposed in a plane generally parallel with the planar disposition of the base 86, the cross member 96 providing a surface 98 (shown in FIG. 7) disposed generally adjacent the second side 28 of the anodic member 12; and a second leg 100 extending a distance generally perpendicularly from the cross member 96 and disposed in a plane generally parallel with the planar disposition of the first leg 92, the second leg 100 providing a surface 102 (shown in FIG. 7) disposed generally adjacent a portion of the first face 22 of the anodic member 12.

As shown more clearly in FIGS. 1, 4 and 7, the second flange 90, has a generally U-shaped cross-section and is formed on the side of the base 86, generally opposite the side having the first flange 88 formed thereon. The second flange 90 includes: a first leg 106 extending a distance generally perpendicularly from the base 86 and providing a surface 108 (shown in FIG. 7) disposed generally adjacent a portion of the second face 36 of the cathodic member 14; a cross member 110 extending a distance generally perpendicularly from the first leg 106 and disposed in a plane generally parallel with the planar disposition of the base 86, the cross member 110 providing a surface 112 (shown in FIG. 7) disposed generally adjacent the second side 40 of the cathodic member 14; and a second leg 114 extending a distance generally perpendicularly from the cross member 110 and disposed in a plane generally parallel with the planar disposition of the first leg 106, the second leg 114 providing a surface 116 (shown in FIG. 7) disposed generally adjacent a portion of the first face 34 of the cathodic member 14.

Figure 5:
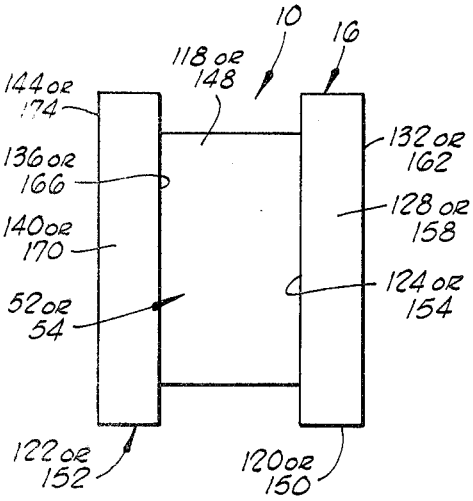
FIG. 5 is a typical first or second end elevational view of the bipolar electrode of FIGS. 1, 2, 3 and 4.

As shown more clearly in FIGS. 1, 5 and 6, the third connector element 52 is constructed in a manner similar to the first and the second connector elements 48 and 50, and the third connector element 52 includes: a base 118 extending between the second face 24 of the anodic member 12 and the second face 36 of the cathodic member 14, a first flange 120 formed on one side of the base 118, and a second flange 122 formed on the opposite side of the base 118.

The first flange 120 is disposed about the first end 30 of the anodic member 12. The first flange 120 includes: a first leg 124 extending a distance generally perpendicular from the base 118 and providing a surface 126 (shown in FIG. 6) disposed generally adjacent a portion of the second face 24 of the anodic member 12; a cross member 128 extending a distance generally perpendicularly from the first leg 124 and disposed in a plane generally parallel with the planar disposition of the base 118, the cross member 128 providing a surface 130 (shown in FIG. 6) disposed generally adjacent the first end 30 of the anodic member 12; and a second leg 132 extending a distance generally perpendicularly from the cross member 128 and disposed in a plane generally parallel with the planar disposition of the first leg 124, the second leg 132 providing a surface 134 (shown in FIG. 6) disposed generally adjacent a portion of the first face 22 of the anodic member 12.

The second flange 122 has a generally U-shaped crossection and is formed on the side of the base 118, generally opposite the side having the first flange 120 formed thereon. The second flange 122 includes: a first leg 136 extending a distance generally perpendicularly from the base 118 and providing a surface 138 (shown in FIG. 6) disposed generally adjacent a portion of the second face 36 of the cathodic member 14; a cross member 140 extending a distance generally perpendicularly from the first leg 136 and disposed in a plane generally parallel with the planar disposition of the base 118, the cross member 140 providing a surface 142 (shown in FIG. 6) disposed generally adjacent the first end 42 of the cathodic member 14; and a second leg 144 extending generally perpendicularly from the cross member 140 and disposed in a plane generally parallel with the planar disposition of the first leg 136, the second leg 144 providing a surface 146 (shown in FIG. 6) disposed generally adjacent a portion of the first face 34 of the cathodic member 14.

As shown more clearly in FIGS. 1, 5 and 6, the fourth connector element 54 is constructed in a manner similar to the first, the second and the third connector elements 48, 50, and 52, and the fourth connector element 54 includes: a base 148 extending between the second face 24 of the anodic member 12 and the second face 36 of the cathodic member 14, a first flange 150 formed on one side of the base 148, and a second flange 152 formed on the opposite side of the base 148.

The first flange 150 has a generally U-shaped crossection and is disposed about the second end 32 of the anodic member 12. The first flange 150 includes: a first leg 154 extending a distance generally perpendicularly from the base 148 and providing a surface 156 (shown in FIG. 6) disposed generally adjacent a portion of the second face 24 of the anodic member 12; a cross member 158 extending a distance generally perpendicularly from the first leg 154 and disposed in a plane generally parallel with the planar disposition of the base 148, the cross member 158 providing a surface 160 (shown in FIG. 6) disposed generally adjacent the second end 32 of the anodic member 12; and a second leg 162 extending a distance generally perpendicularly from the cross member 158 and disposed in a plane generally parallel with the planar disposition of the first leg 154, the second leg 162 providing a surface 164 (shown in FIG. 6) disposed generally adjacent a portion of the first face 22 of the anodic member 12.

The second flange 152 has a generally U-shaped cross-section and is formed on the side of the base 148, generally opposite the side having the first flange 150 formed thereon. The second flange 152 includes: a first leg 166 extending a distance generally perpendicularly from the base 148 and providing a surface 168 (shown in FIG. 6) disposed generally adjacent a portion of the second face 36 of the cathodic member 14; a cross member 170 extending a distance from the first leg 166 and disposed in a plane generally parallel with the planar disposition of the base 148, the cross member 170 providing a surface 172 (shown in FIG. 6) disposed generally adjacent the second end 44 of the cathodic member 14; and a second leg 174 extending a distance generally perpendicularly from the cross member 170 and disposed in a plane generally parallel with the planar disposition of the first leg 166, the second leg 174 providing a surface 176 (shown in FIG. 6) disposed generally adjacent a portion of the first face 34 of the cathodic member 14.

In the assembled position, the first, the second, the third and the fourth connector elements 48, 50, 52 and 54 are connected to the anodic and the cathodic members 12 and 14. One end of the first connector element 48 is disposed near one end of the fourth connector element 54 and the ends of the first and the fourth connector elements 48 and 54 are connected by a seal member 180 (shown in FIGS. 1, 2 and 3) extending along the ends and forming a seal between the first and the fourth connector elements 48 and 54. One end of the first connector element 48, opposite the end connected to the fourth connector element 54, is disposed near one end of the third connector element 52 and the ends of the first and the third connector elements 48 and 52 are connected by a seal member 182 (shown in FIGS. 1, 2 and 3) extending along the ends and forming a seal between the first and the third connector elements 48 and 52. One end of the second connector element 50 is disposed near the end of the third connector element 52, opposite the end of the third connector element 52 connected to the first connector element 48, and the ends of the second and the third connector elements 50 and 52 are connected by a seal member 184 (shown in FIGS. 1, 2 and 3) extending along the ends and forming a seal between the second and the third connector elements 50 and 52. The end of the second connector element 50, opposite the end connected to the third connector element 52, is disposed near the end of the fourth connector element 54, opposite the end connected to the first connector element 48, and the ends of the second and the fourth connector elements 50 and 54 are connected by a seal member 186 (shown in FIGS. 1, 2 and 3) extending along the ends and forming a seal between the second and the fourth connector elements 50 and 54. In one form, the seal members 180, 182, 184 and 186 comprise an epoxy bonding material or the like and, in another form, the seal members 180, 182, 184 and 186 comprise a weld material suitable for weldingly connecting the connector elements 48, 50, 52 and 54.

Also, the first, the second, the third and the fourth connector elements 48, 50, 52 and 54 are sealingly connected to the anodic and the cathodic members 12 and 14. The connector elements 48, 50, 52 and 54 cooperate with the anodic and the cathodic members 12 and 14 to encompass the space 18 and the connector elements 48, 50, 52 and 54 are sealingly connected to the anodic and the cathodic members 12 and 14 to substantially prevent electrolyte from entering the space 18.

A seal member 188 (shown in FIG. 3) is connected to the first connector element 48 and first face 22 of the anodic member 12, thereby forming a seal between the first connector element 48 and the first face 22 of the anodic member 12. A seal member 190 (shown in FIG. 3) is connected to the second connector element 50 and the first face 22 of the anodic member 12, thereby forming a seal between the second connector element 50 and the first face 22 of the anodic member 12. A seal member 192 (shown in FIG. 3) is connected to the third connector element 52 and the first face 22 of the anodic member 12, thereby forming a seal between the third connector element 52 and the first face 22 of the anodic member 12. A seal member 194 (shown in FIG. 3) is connected to the fourth connector element 54 and the first face 22 of the anodic member 12, thereby forming a seal between the fourth connector element 54 and the first face 22 of the anodic member 12.

A seal member 196 (shown in FIGS. 1 and 2) is connected to the first connector element 48 and the first face 34 of the cathodic member 14, thereby forming a seal between the first connector element 48 and the first face 34 of the cathodic member 14. A seal member 198 (shown in FIGS. 1 and 2) is connected to the second connector element 50 and the first face 34 of the cathodic member 14, thereby forming a seal between the second connector element 50 and the first face 34 of the cathodic member 14. A seal member 200 (shown in FIGS. 1 and 2) is connected to the third connector element 52 and the first face 34 of the cathodic member 14, thereby forming a seal between the third connector element 52 and the first face 34 of the cathodic member 14. A seal member 202 (shown in FIGS. 1 and 2) is connected to the fourth connector element 54 and the first face 34 of the cathodic member 14, thereby forming a seal between the fourth connector element 54 and the first face 34 of the cathodic member 14.

In one form the seal members 188, 190, 192, 194, 196, 198, 200 and 202 each comprise or, in other words, are formed of an epoxy bonding material or the like. In another form, the seal members 188, 190, 192, 194, 196, 198, 200 and 202 each comprise or, in other words, are formed via a weld material suitable for weldingly connecting the connector elements 48, 50, 52 and 54 to the anodic and the cathodic members 12 and 14.

The seal members 180, 182, 184 and 186 sealingly connect the connector elements 48, 50, 52 and 54 to form the connector 16, and the seal members 180, 182, 184 and 186 cooperate with the seal members 188, 190, 192, 194, 196, 198, 200 and 202 to sealingly connect the connector 16 to the anodic and the cathodic members 12 and 14 for substantially preventing electrolyte from entering the space 18 between the second face 24 of the anodic member 12 and the second face 36 of the cathodic member 14. As mentioned before, the connector 16 is constructed of an electrically conductive material, such as copper, for example, and the surfaces 62, 66, 70, 76, 80, 84, 94, 98, 102, 108, 112, 116, 126, 130, 134, 138, 142, 146, 156, 160, 164, 168, 172 and 176 of the connector 16 engage portions of the anodic and the cathodic members 12 and 14, the connector 16 establishing electrical continuity between the anodic member 12 and the cathodic member 14. Further, in the embodiment of the invention shown in FIGS. 1 through 9, the connector 16 cooperates to mechanically support the anodic member 12 and the cathodic member 14 in a spaced apart relationship with the second face 24 of the anodic member 12 spaced the distance 46 from the second face 36 of the cathodic member 14, thereby forming a unitary, self-supporting bipolar electrode which can be installed in an electrolytic cell in a convenient manner.

As mentioned before, the bipolar electrode 10 of the present invention is particularly useful in an alkali metal chlorate or chlorine electrolytic cell for the electrolysis of aqueous solutions of alkali metal chlorides. Diagrammatically and schematically shown in FIGS. 6 and 7 is an electrolytic cell 230 comprising: a cell box 232, having opposite side walls 234 and 236, opposite end walls 238 and 240 and bottom 242, the side walls 234 and 236, the end walls 238 and 240 and the bottom 242 cooperate to define a space 244 for retaining the electrolyte. The electrolytic cell 230 also includes a monopolar anodic electrode 246 which is connected via conventional means to the positive side of an electrical power source 248 (more particularly, a direct-current type of power source), and a monopolar cathodic electrode 250, which is connected via conventional means to the negative side of the electrical power source 248. At least one bipolar electrode 10 is disposed between the anodic electrode 246 and the cathodic electrode 250. Only one bipolar electrode 10 is shown in FIG. 6, although it is understood that two or more bipolar electrodes 10 may be installed in a commercial electrolytic cell 230, each of the bipolar electrodes 10 being disposed between the anodic electrode 246 and the cathodic electrode 250.

In one form, the cell box 232 is constructed of an inert material, such as polyvinyl chloride, for example, and includes a plurality of openings 252 formed through the bottom 242 for introducing the electrolyte into the space 244 formed in the cell box 232. A plurality of channels are formed in the side wall 234, only four channels being shown in FIG. 6 and designated therein via the reference numerals 254, 256, 258 and 260, and a plurality of channels are formed in the side wall 236, each of the channels formed in the side wall 236 being aligned with one of the channels 254, 256, 258 and 260 formed in the side wall 234 (only four channels being shown in the side wall 236 in FIG. 6 and designated therein via the reference numerals 262, 264, 266 and 268).

A channel 269 (shown in FIG. 7) is formed in the bottom 242 and the channel 269 is aligned with the channels 256 and 264 (shown in FIG. 6), the aligned channels 256, 264 and 269 forming a continuous channel in the cell box 232 for retainingly and supportingly receiving a portion of the bipolar electrode 10. A channel 271 (shown in FIG. 7) is formed in the bottom 242 and the channel 271 is aligned with the channels 258 and 266 (shown in FIG. 6) the aligned channels 258, 266 and 271 forming a continuous channel in the cell box 232 for retainingly and supportingly receiving a portion of the bipolar electrode 10.

As shown in FIG. 6, the monopolar anodic electrode 246 has opposite sides 270 and 272 and a surface 274 functioning as an anodic surface during the operation of the electrolytic cell 230. The aligned channels 254 and 262 are sized and positioned to slidingly receive the anodic electrode 246. The anodic electrode 246 is supported within the space 244 and extends between the side walls 234 and 236, the anodic electrode 246 being at least partially immersed in the electrolyte during the operation of the electrolytic cell 230.

As shown in FIG. 6, the monopolar cathodic electrode 250 has opposite sides 276 and 278 and a surface 280 operating as a cathodic surface during the operation of the electrolytic cell 230. The aligned channels 260 and 268 are sized and positioned to slidingly receive the cathodic electrode 250. The cathodic electrode 250 is supported within the space 244 and extends between the side walls 234 and 236, the cathodic electrode 250 being at least partially immersed in the electrolyte during the operation of the electrolytic cell 230.

The aligned channels 256, 264 and 269 and the aligned channels 258, 266 and 271 in the cell box 232 are sized and positioned to slidingly receive the bipolar electrode 10 of the present invention. The bipolar electrode 10 is supported within the space 244 and extends between the side walls 234 and 236.

Assuming the electrolytic cell 230 included only the monopolar electrodes 246 and 250, the electrical power source 248 would be connected to the monopolar electrodes 246 and 250, and the current would flow from the anodic surface 274, through the electrolyte in the space 244, and to the cathodic surface 280. The anodic surface 274 and the cathodic surface 280 are spaced a distance apart and the electrolyte is disposed generally between the anodic surface 274 and the cathodic surface 280. Further, the anodic monopolar electrode 246 is not mechanically connected to the cathodic electrode 250. Assuming further that the electrolytic cell 230 included a plurality of monopolar anodic electrodes and a plurality of monopolar cathodic electrodes, the monopolar anodic electrodes would be connected in parallel to the electrical power source and the monopolar cathodic electrodes would be connected in parallel to the electrical power source. This type of arrangement just described would constitute a typical prior art monopolar electrode type of electrolytic cell configuration.

The present invention is directed to an electrolytic cell which includes at least one bipolar electrode, in contrast to the electrolytic cell which includes only monopolar electrodes described above. Thus, the electrolytic cell 230, shown in FIG. 6, includes the monopolar anodic electrode 246, the monopolar cathodic electrode 250 and one or more of the bipolar electrodes 10 of the present invention supported within the cell box 232 space 244, generally between the monopolar electrodes 246 and 250, and at least partially immersed in the electrolyte during the operation of the electrolytic cell 230.

Referring to an electrolytic cell 230 with one bipolar electrode 10, for example, the bipolar electrode 10 is supported within the space 244 and extends between the side walls 234 and 236. The channels 254, 256, 258, 260, 262, 264, 266, 268, 269 and 271 are positioned to support the electrodes 10, 246 and 250 in a spaced apart relationship. The bipolar electrode 10 is oriented such that the anodic surface formed on the first face 22 of the anodic member 12 generally faces and is spaced a distance from the cathodic surface 280 formed on the monopolar cathodic electrode 250 and the cathodic surface formed on the first face 34 of the cathodic member 14 generally faces and is spaced a distance from the anodic surface 274 formed on the monopolar anodic electrode 246, the cathodic member 14 and the anodic member 12 of the bipolar electrode 10 being mechanically connected in series electrically.

During the operation of the electrolytic cell 230 of the present invention, the current flows from the anodic surface 274 of the monopolar anodic electrode 246 through the electrolyte to the cathodic surface formed on the first face 34 of the bipolar electrode 10; the current flows through the bipolar electrode 10 from the cathodic member 14 to the anodic member 12 via the connector 16; the current flows from the anodic surface formed on the first face 22 of the bipolar electrode 10 through the electrolyte to the cathodic surface 280 formed on the monopolar cathodic electrode 250.

During the operation of the electrolytic cell 230 the electrolyte is introduced into the space 244 of the cell box 232 via the openings 252, and the electrolyte is removed from the space 244 of the cell box 232 by overflowing over a top 282 (shown in FIG. 8) of the cell box 232 or, in some instances, by passing the electrolyte through openings (not shown) in the cell box 232 generally near the top 282 thereof. In some applications, the cell box 232 is supported within a larger cell tank (not shown) and the electrolyte is retained within the cell tank circulated into the cell box 232 from the cell tank, removed from the cell box 232 and circulated back into the cell tank, a cooling coil being disposed in the cell tank in contact with the electrolyte for maintaining the electrolyte at a predetermined temperature level during the electrolysis operation. The construction and operation of cell boxes and cell tanks and the use of cell boxes in electrolytic applications is well known in the art, and a further detailed description is not required herein.

If electrolyte is allowed to pass over the connector 16 or, in other words, if electrolyte leaks around the bipolar electrode 10 passing over the connector 16, the efficiency of the electrolytic cell 230 is reduced. The electrolytic cell 230 is constructed to reduce substantially the possibility of electrolyte from passing around the bipolar electrode 10 via the connector 16.

Figure 8:
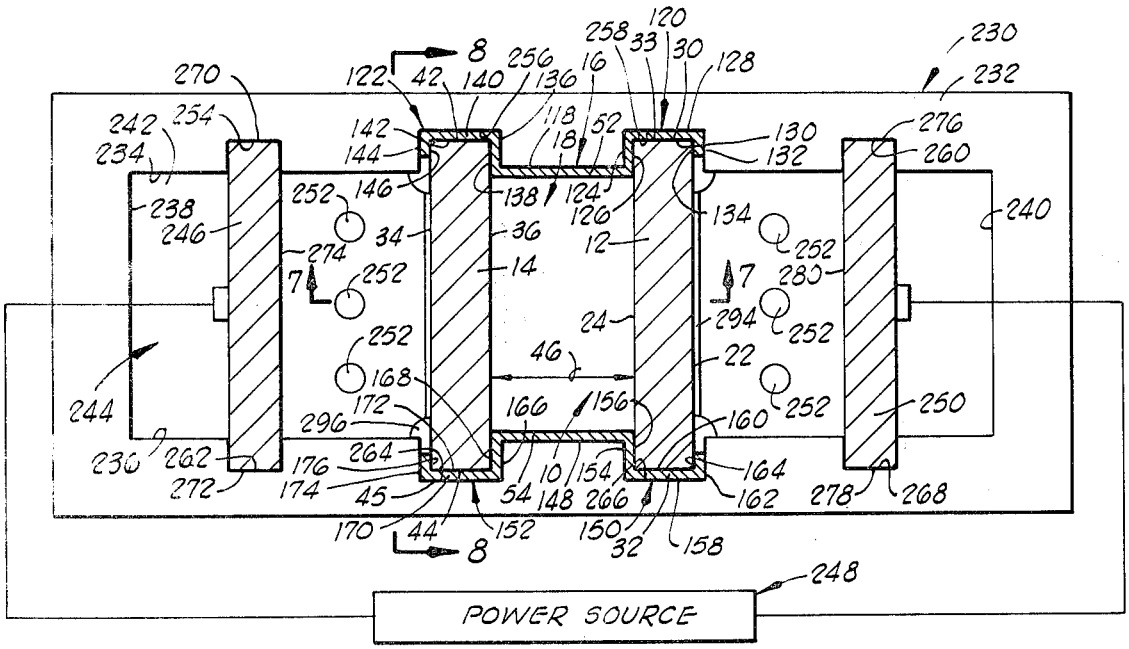
FIG. 8 is a sectional view, taken substantially along the lines 8—8 of FIG. 6.
Figure 8:
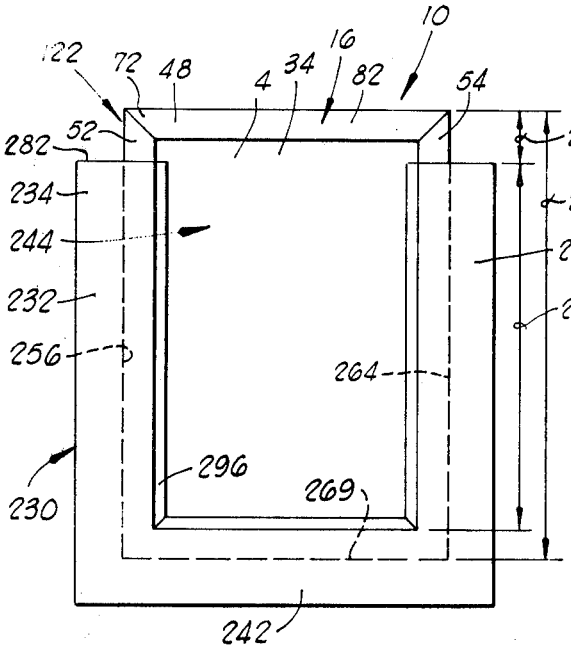

In one form, as shown more clearly in FIG. 8, the side walls 234 and 236 and the end walls 238 and 240 each extend perpendicularly from the bottom 242 a distance 284 terminating with the upper peripheral surface or top 282 of the cell box 232. The first side 26 of the anodic member 12 is spaced a distance 286 (more particularly, the distance 286 in FIG. 8 is the height of the bipolar cell 10; that is the distance between the surfaces of cross members 64 and 96 opposed to surfaces 66 and 98) from the second side 28, and the first side 38 of the cathodic member 14 is spaced the distance 286 from the second side 40. The distance 286 is greater than the distance 284 and the distance 286 is sized such that the first sides 26 and 38 of the anodic and the cathodic members 12 and 14, respectively, are disposed a distance 288 above the top 282 of the cell box 232. In this manner, the electrolyte does not flow across the connector 16 in those applications where the electrolyte is discharged from the cell box 232 by overflowing the electrolyte over the top 282 of the cell box 232, the flowing of the electrolyte across the connector 16 resulting in a decrease in the efficiency of the electrolytic cell 230.

Figure 9:
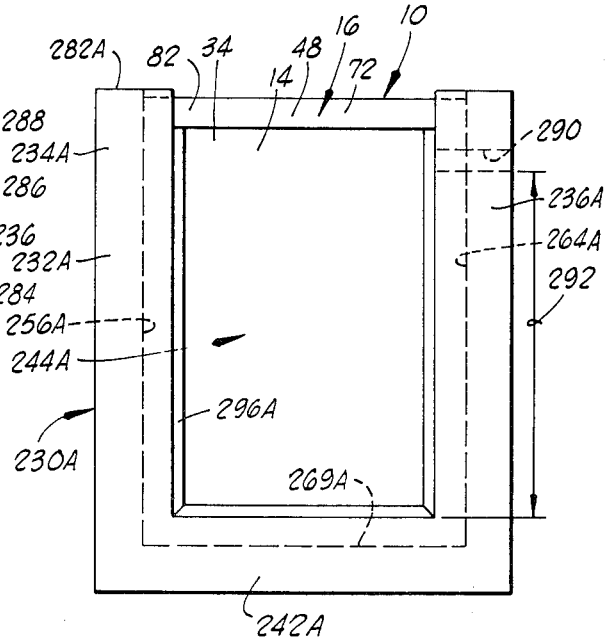
FIG. 9 is a sectional view, similar to FIG. 8, but showing the bipolar electrode 10 installed in a modified electrolytic cell.

In one other form, as shown more clearly in FIG. 9, the cell box 232A includes a plurality of discharge openings 290, each discharge opening 290 extending through one of the side walls 234A and 236A. Each discharge opening 290 is spaced a distance 292 above the bottom 242A. The distance 292 is less than the distance 286 so the electrolyte is discharged from the cell box 232A at a position and in a manner substantially preventing the electrolyte from passing or flowing over the connector 16, which would decrease the efficiency of the electrolytic cell 230A.

In yet another form, the connector 16 can be constructed in a manner substantially reducing the possibilities of electrolyte passing over the connector 16 by constructing the first connector element 48 and those portions of the third and fourth connector elements 52 and 54 which might be exposed to the electrolyte of a non-conductive material. In still another form, the portion of the connector elements 48, 50, 52 and 54, which might be exposed to the electrolyte, are covered via a non-conductive material and sealingly enclosed via such material.

In addition to the foregoing, after the bipolar electrode 10 has been disposed in the channels 256, 258, 264 and 266 of the cell box 232, a seal is formed between portions of the bipolar electrode 10 and portions of the cell box 232 to prevent substantially the possibilities of electrolyte passing around the bipolar electrode 10 via the connector 16. More particularly, a portion of a seal member 294 is connected to the side wall 234 and to a portion of the first face 22 of the anodic member 12, thereby forming a seal therebetween; a portion of the seal member 294 is connected to the bottom 242 and to a portion of the first face 22 of the anodic member 12, thereby forming a seal therebetween; and a portion of the seal member 294 is connected to the side wall 236 and to a portion of the first face 22 of the anodic member 12, thereby forming a seal therebetween. A portion of a seal member 296 is connected to the side wall 234 and to a portion of the first face 34 of the cathodic member 14, thereby forming a seal therebetween; a portion of the seal member 296 is connected to the bottom 242 and to a portion of the first face 34 of the cathodic member 14, thereby forming a seal therebetween; and a portion of the seal member 296 is connected to the side wall 236 and to a portion of the first face 34 of the cathodic member 14, thereby forming a seal therebetween. Thus, the seal member 294 provides a seal between the first face 22 of the anodic member 12 and the adjacent portions of the cell box 232 for substantially preventing electrolyte from leaking between the anodic member 12 and the cell box 232, and the seal member 296 provides a seal between the first face 34 of the cathodic member 14 and the adjacent portions of the cell box 232 for substantially preventing electrolyte from leaking between the cathodic member 14 and the cell box 232.

The connector 16 is connected to the anodic member 12 and the cathodic member 14 such that connector 16 contactingly engages the anodic and the cathodic members 12 and 14 over a contact surface area which is sufficient to establish electrical continuity between the anodic and the cathodic members 12 and 14, to accommodate the design current load of the bipolar electrode 10, to provide a substantially uniform current density on the anodic and the cathodic members 12 and 14, and to provide efficient transfer of current during the operation of the bipolar electrode 10 in an electrolytic cell type of operation. Further, the contact surface area between the connector 16 and the anodic and the cathodic members 12 and 14 is sufficient to provide a relatively low electrical power drop between the anodic and the cathodic members 12 and 14 during the operation of the bipolar electrode 10.

The second legs 68, 100, 132 and 162 provide the surfaces 70, 102, 134 and 164, respectively, which contact the first face 22 of the anodic member 12 and increase the contact area between the anodic member 12 and the connector 16. The second legs 82, 114, 144 and 174 provide the surfaces 84, 116, 146 and 176, respectively, which contact the first face 34 of the cathodic member 14 and increase the contact area between the cathodic member 14 and the connector 16. The contact areas provided via the surfaces 70, 84, 102, 116, 134, 146, 164 and 176 can be increased by increasing the length of the second legs 68, 82, 100, 114, 132, 144, 162 and 174 or, in other words, by increasing the area of the first faces 22 and 34 of the anodic and cathodic members 12 and 14, respectively, contacted by connector 16. The area of the first faces 22 and 34 which is contacted via the connector 16 is limited by the criteria that a certain portion of the first faces 22 and 34 and must be exposed to the electrolyte for the bipolar electrode 10 to function properly in the electrolytic cell type of application. Further, the area of the first faces 22 and 34 which is contacted via the connector 16 is limited by the criteria that the connector 16 should be disposed and sealed so the connector 16 is not contacted via the electrolyte during the operation of the electrolytic cell 130.

The second leg 100 of the first flange 58 portion of the second connector element 50 extends a distance along the first face 22 of the anodic member 12. However, in one preferred embodiment, the second leg 100 and the channel 271 are each sized such that the second leg 100 does not extend beyond the bottom 242 or, in other words, the depth of the channel 271 is greater than the length of second leg 100. A portion of the seal member 294 extends into the space formed between the end of the second leg 100, the first face 22 of the anodic member 12 and a portion of the bottom 242 formed via the channel 271.

The second leg 132 of the first flange 120 portion of the third connector element 52 extends a distance along the first face 22 of the anodic member 12. However, in one preferred embodiment, the second leg 132 and the channel 258 in the side wall 234 are each sized such that the second leg 132 does not extend beyond the side wall 234 or, in other words, the depth of the channel 258 is greater than the length of the second leg 132. A portion of the seal member 294 extends into the space formed between the end of the second leg 132, the first face 22 of the anodic member 12 and a portion of the side wall 234 formed via the channel 258.

The second leg 162 of the first flange 150 portion of the fourth connector element 54 extends a distance along the first face 22 of the anodic member 12. However, in one preferred form, the second leg 162 and the channel 266 are each sized such that the second leg 162 does not extend beyond the side wall 236 or, in other words, the depth of the channel 266 is greater than the length of the second leg 162, a portion of the seal member 294 extends into the space formed between the end of the second leg 162, the first face 22 of the anodic member 12 and a portion of the side wall 236 formed via the channel 266.

The second leg 114 of the second flange 90 portion of the second connector element 50 extends a distance along the first face 34 of the cathodic member 14. However, in one preferred embodiment, the second leg 114 and the channel 269 are each sized such that the second leg 114 does not extend beyond the bottom 242 or, in other words, the depth of the channel 269 is greater than the length of the second leg 114. A portion of the seal member 296 extends into the space formed between the end of the second leg 114, the first face 34 of the cathodic member 14 and a portion of the bottom 242 formed via the channel 269.

The second leg 144 of the second flange 122 portion of the third connector element 52 extends a distance along the first face 34 of the cathodic member 14. However, in one preferred embodiment, the second leg 144 and the channel 156 in the side wall 234 are each sized such that the second leg 144 does not extend beyond the side wall 234 or, in other words, the depth of the channel 256 is greater than the length of the second leg 144. A portion of the seal member 296 extends into the space formed between the end of the second leg 144, the first face 34 of the cathodic member 14 and a portion of the side wall 234 formed via the channel 256.

The second leg 174 of the second flange 152 portion of the fourth connector element 54 extends a distance along the first face 34 of the cathodic member 14. However, in one preferred embodiment, the second leg 174 and the channel 264 are each sized such that the second leg 174 does not extend beyond the side wall 236 or, in other words, the depth of the channel 264 is greater than the length of the second leg 174. A portion of the seal member 296 extends into the space formed between the end of the second leg 164, the first face 34 of the cathodic member 14 and a portion of the side wall 236 formed via the channel 264.

Thus, the seal members 294 and 296 cooperate to sealingly isolate the connector elements 48, 50, 52 and 54 and to sealingly prevent electrolyte from contacting the connector elements 50, 52 and 54. As mentioned before, the cell box 232 and the bipolar electrode 10 are constructed such that first connector element 48 is disposed above the electrolyte. The seal members 294 and 296 each comprise or, in other words, are formed of an epoxy bonding material or the like, in one form, or, in one other form, the seal members 294 and 296 each comprise a weld material suitable for weldingly connecting the anodic and the cathodic members 12 and 14 and the cell box 232.

EMBODIMENT OF FIGS. 10 AND 11

Figure 10:
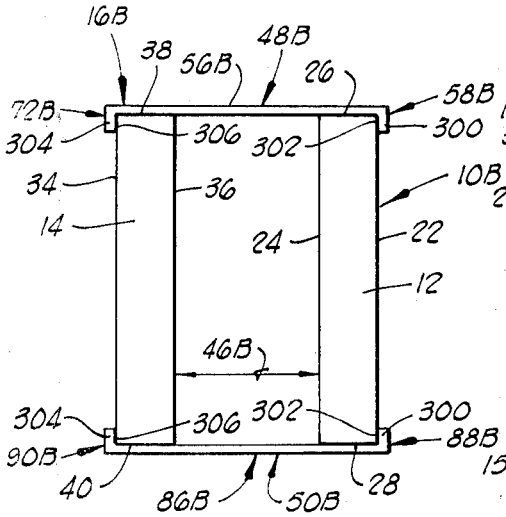
FIG. 10 is a sectional view of a modified bipolar electrode.
Figure 11:
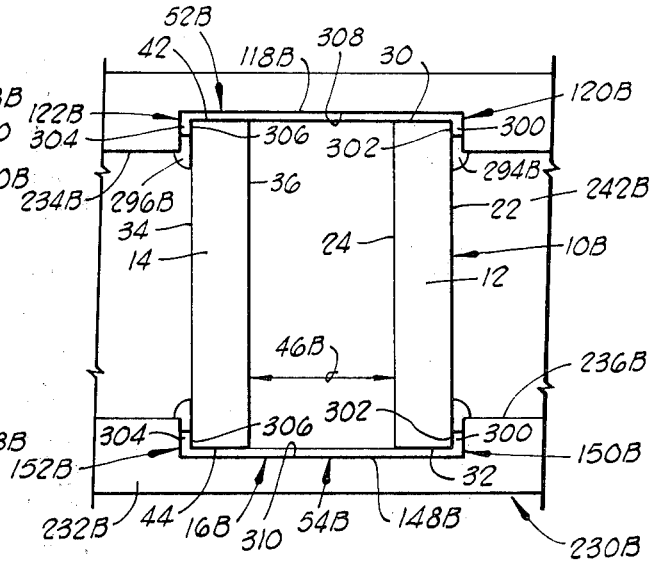
FIG. 11 is a sectional view showing the modified bipolar electrode of FIG. 10 installed in an electrolytic cell, only a fragmentary portion of the electrolytic cell being shown in FIG. 11.

Shown in FIGS. 10 and 11 is a modified bipolar electrode 10B which is constructed exactly like the bipolar electrode 10, shown in FIGS. 1 through 9 and described before, except the bipolar electrode 10B has a modified connector 16B having modified bases 56B, 86B, 118B and 148B, and modified first and second flanges 58B, 72B, 88B, 90B, 120B, 122B, 150B and 152B.

Each of the modified first flanges 58B, 88B, 120B and 150B includes a leg 300 having one end connected to the base and extending a distance generally perpendicularly therefrom. Each of the leg 300 provides a surface 302 which is disposed generally adjacent and contactingly engages the first face 22 of the anodic member 12.

Each of the modified second flanges 72B, 90B, 122B and 152B includes a leg 304 having one end connected to the base and extending a distance generally perpendicularly from the base. Each of the leg 304 provides a surface 306 which is disposed generally adjacent the first face 34 of the cathodic member 14.

As shown in FIG. 11, the cell box 232B includes aligned channels 308 and 310 for slidingly receiving the bipolar electrode 10B in lieu of the four channels required to slidingly accommodate the bipolar electrode 10, as described above.

The bipolar electrode 10B will operate in the electrolytic cell in a manner like that described before with respect to the bipolar electrode 10.

EMBODIMENT OF FIG. 12

Figure 12:
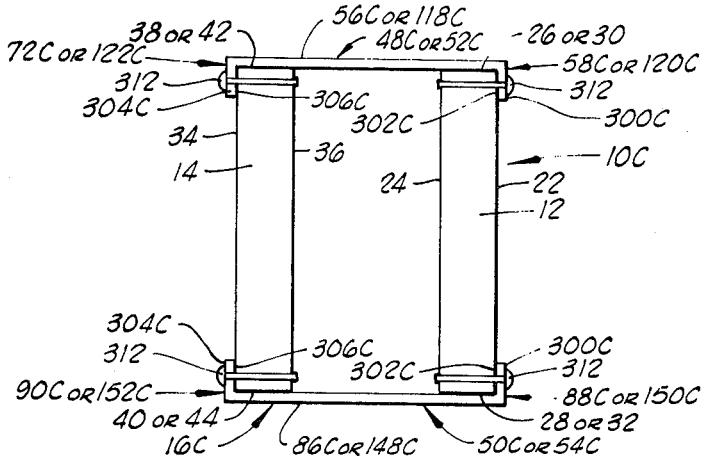
FIG. 12 is a sectional view of another modified bipolar electrode.

The bipolar electrode 10C, shown in FIG. 12, is constructed exactly like the bipolar electrode 10B shown in FIGS. 10 and 11, except a plurality of fasteners 312 are disposed through the legs 300C and 304C, the fasteners 312 also extending through the anodic member 12 and the cathodic member 14. The fasteners 312 provide a mechanical connection between the connector 16C and the anodic and the cathodic members 12 and 14 to enhance the contacting engagement between the connector 16C and the anodic and the cathodic members 12 and 14 for substantially assure the required electrical contact and mechanical inter-connection between the connector 16C and the anodic and the cathodic members 12 and 14.

EMBODIMENT OF FIGS. 13 AND 14

Figure 13:
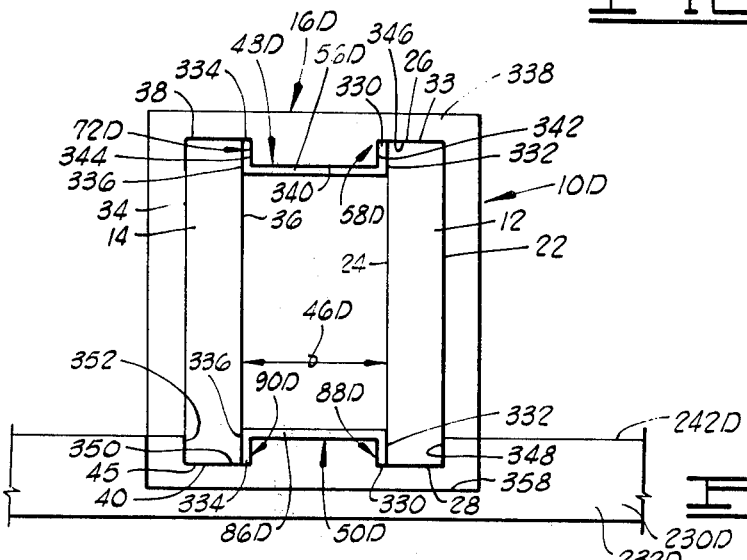
FIG. 13 is a sectional view of still another modified bipolar electrode installed in an electrolytic cell, only a fragmentary portion of the electrolytic cell being shown in FIG. 13.
Figure 14:
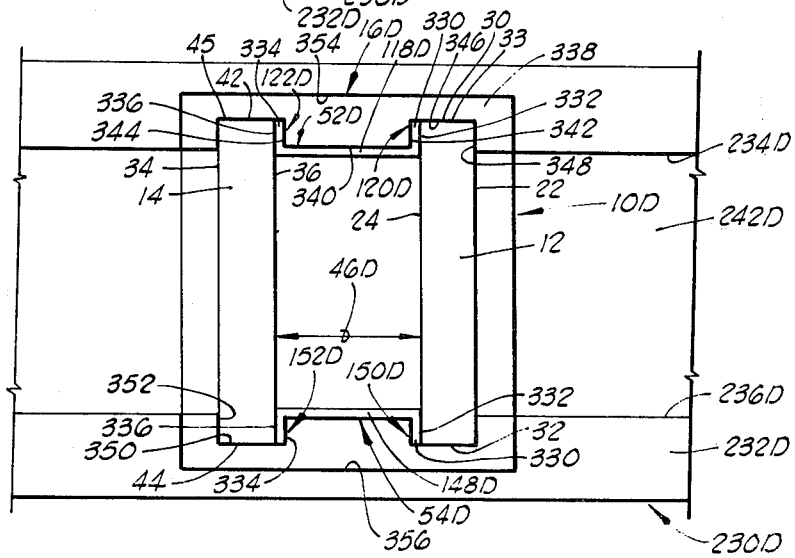
FIG. 14 is a sectional view of the bipolar electrode of FIG. 13, only a fragmentary portion of the electrolytic cell being shown in FIG. 14.

The modified bipolar electrode 10D, shown in FIGS. 13 and 14 is constructed exactly like the bipolar electrode 10, described before, except, the bipolar electrode 10D has a modified connector 16D having modified base portions 56D, 86D, 118D and 148D and modified first and second flanges 58D, 72D, 88D, 90D, 120D, 122D, 150D and 152D.

Each of the modified first flanges 58D, 88D, 120D and 150D includes a leg 330 having one end connected to the base and extending a distance generally perpendicularly therefrom. Each of the legs 330 provides a surface 332 which is disposed generally adjacent the second face 24 of the anodic member 12.

Each of the modified second flanges 72D, 90D, 122D and 152D includes a leg 334 having one end connected to the base and extending a distance generally perpendicularly therefrom. Each of the legs 334 provides a surface 336 which is disposed generally adjacent the second face 36 of the cathodic member 14.

An elastomeric seal member 338 is sealingly secured to portions of the anodic and the cathodic members 12 and 14 and to portions of the connector 16D. The elastomeric seal member 338 extends peripherally about the assembled anodic and cathodic members 12 and 14 and the connector 16D. More particularly, the seal member 338 includes: an annular surface 340 which is sealingly secured to the bases 56D, 86D, 118D and 148D; an annular surface 342 which is sealingly secured to the legs 330; an annular surface 344 which is sealingly secured to the legs 334; an annular surface 346 which is sealingly secured to the outer peripheral surface 33 of the anodic member 12; an annular surface 348 which is sealingly secured to a portion of the first face 22 of the anodic member 12, generally near the outer peripheral surface 33 thereof; an annular surface 350 which is sealingly secured to the outer peripheral surface 45 of the cathodic member 14; and an annular surface 352 which is sealingly secured to a portion of the first face 34 of the cathodic member 14, generally near the outer peripheral surface 45 of the cathodic member 14. The elastomeric seal member 338 cooperates with the connector 16D to mechanically connect and support the anodic member 12 and the cathodic member 14 in the spaced apart relationship with the second face 24 spaced the distance 46D from the second face 36, and the elastomeric seal member 338 sealingly isolates the connector 16D from the electrolyte during the operation of the electrolytic cell 230D.

The modified cell box 232D includes: a channel 354 formed in the side wall 234D, a channel 356 formed in the side wall 236D, and a channel 358 formed in the bottom 242D. The channels 354, 356 and 358 are aligned and sized to slidingly receive the bipolar electrode 10D including the seal member 338.

In an assembled position, the bipolar electrode 10D is disposed in the aligned channels 354, 356 and 358 and positioned in the cell box 232D, extending generally between the side walls 234D and 236D. In one form, the seal member 338 is slightly larger than the channels 354, 356 and 358 so the seal member 338 is slightly compressed between the walls formed in the cell box 232D via the channels 354, 356 and 358. In this manner, the seal member 338 sealingly engages the side walls 234D and 236D and the bottom 242D and the seal member 338 sealingly prevents electrolyte from leaking between the seal member 338 and the adjacent portions of the cell box 232D, during the operation of the electrolytic cell 230D.

The anodic and the cathodic members 12 and 14, the connector 16D and the seal member 338 are secured in an assembled position to provide a unitary structure which can be installed in and removed from the cell box 232D in a relatively quick and convenient manner. Further, since the seal member 338 sealingly isolates the connector 16D from the electrolyte and sealingly prevents electrolyte from leaking between the bipolar electrode 10D and the cell box 232D, it is not necessary to utilize additional seal members, such as the seal members 294 and 296 utilized in connection with the bipolar electrodes 10, 10A, 10B and 10C, for example, which sealingly connect the bipolar electrode to the cell box.

The bipolar electrode 10D operates in the electrolytic cell 230D in a manner like that described before with respect to the bipolar electrode 10.

Changes may be made in the construction and the arrangement of the various parts or the elements of the embodiments disclosed herein or in the steps of the method disclosed herein without departing from the spirit and the scope of the invention as defined in the following claims.

What is claimed is:

1. A bipolar electrode for use in an electrolytic cell wherein the bipolar electrode is at least partially immersed in an electrolyte, the bipolar electrode comprising:

an anodic member having a first side, a second side, a first end, a second end, a first face and a second face;

a cathodic member having a first side, a second side, a first end, a second end, a first face and a second face of the cathodic member generally facing the second face of the anodic member and being spaced a distance therefrom; and a connector constructed of an electrically conductive material, a portion of the connector engaging the portion of the anodic member, a portion of the connector engaging a portion of the cathodic member, and a portion of the connector extending between the second face of the anodic member and the second face of the cathodic member, the connector mechanically connecting the anodic and the cathodic members in the spaced apart relationship and establishing electrical continuity between the anodic and the cathodic members, the connector extending about a substantial portion of the space between the anodic and the cathodic members and cooperating with the anodic and the cathodic members to substantially encompass and substantially seal a substantial portion of the space between the anodic and the cathodic members from the electrolyte, comprising:

a third connector element comprising:

a base extending between the anodic and the cathodic members;

a first flange connected to the base and engaging a portion of the anodic member generally near the first end; and a second flange connected to the base and engaging a portion of the cathodic member generally near the first end;

a fourth connector element comprising:

a base extending between the anodic and the cathodic members;

a first flange connected to the base and engaging a portion of the anodic member generally near the second end; and a second flange connected to the base and engaging a portion of the cathodic member generally near the second end.

2. The bipolar electrode of claim 1 wherein the connector includes portions engaging the second face of the anodic member and portions engaging the second face of the cathodic member.

3. The bipolar electrode of claim 1 wherein the connector includes portions engaging the anodic member generally near the first side and portions engaging the cathodic member generally near the first side.

4. The bipolar electrode of claim 3 wherein the connector includes portions engaging the second face of the anodic member and portions engaging the second face of the cathodic member.

5. The bipolar electrode of claim 4 wherein the connector includes portions engaging the first side, the second side, the first end and the second end of the anodic member, and portions engaging the first side, the second side, the first end and the second end of the cathodic member.

6. The bipolar electrode of claim 1 wherein the connector includes portions engaging the first face of the anodic member and portions engaging the first face of the cathodic member.

7. The bipolar electrode of claim 1 wherein the connector is defined further to include:

a second connector element comprising:

a base extending between the anodic and the cathodic members;

a first flange connected to the base and engaging a portion of the anodic member generally near the second side; and a second flange connected to the base and engaging a portion of the cathodic member generally near the second side.

8. The bipolar electrode of claim 3 wherein the connector is defined further to include:

a first connector element comprising:

a base extending between the anodic and the cathodic members;

a first flange connected to the base and engaging a portion of the anodic member generally near the first side; and a second flange connected to the base and engaging a portion of the cathodic member generally near the first side.

9. The bipolar electrode of claim 8 wherein the first flanges of the first, second, third and fourth connector elements are each defined further to include: a leg connected to the base and extending a distance therefrom providing a surface engaging the second face of anodic member; and wherein the second flanges of the first, second, third and fourth connector elements are each defined further to include: a leg connected to the base and extending a distance therefrom providing a surface engaging the second face of the cathodic member.

10. The bipolar electrode of claim 8 wherein the first flanges of the first, second, third and fourth connector elements are each defined further to include: a leg providing a surface engaging the first face of the anodic member; and wherein the second flanges of the first, second, third and fourth connector elements are each defined further to include: a leg providing a surface engaging the first face of the cathodic member.

11. The bipolar electrode of claim 10 defined further to include: a plurality of fasteners, some of the fasteners extending through the leg of the first flanges of the first, second, third and fourth connector elements and connecting the first flanges to the anodic member, and some of the fasteners extending through the leg of the second flanges of the first, second, third and fourth connector elements and connecting the second flanges to the cathodic member.

12. The bipolar electrode of claim 8 wherein the first connector element is connected to third and the fourth connector elements and wherein the second connector element is connected to the third and the fourth connector elements, the first, the second, the third and the fourth connector elements cooperating to enclose a portion of the space between the anodic and the cathodic members and to mechanically support the anodic and the cathodic members in the spaced apart relationship.

13. The bipolar electrode of claim 1 defined further to include: an elastomeric seal member sealingly engaging portions of the anodic member, the cathodic member and the connector for substantially preventing electrolyte from contacting the connector and for cooperating with the connector to substantially prevent electrolyte from entering the space between the anodic and the cathodic members.

14. The bipolar electrode of claim 1 defined further to include: means sealingly engaging portions of the anodic member, the cathodic member and the connector for substantially preventing electrolyte from passing between the engaging portions of the connector and the anodic and the cathodic members.

15. The bipolar electrode of claim 1 wherein the bipolar electrode is constructed for at least partial immersion in an electrolyte and wherein the bipolar electrode is defined further to include:

a cell box having side walls and end walls surrounding a space for accommodating electrolyte;

an anodic electrode disposed in the cell box for at least partially immersion in the electrolyte;

a cathodic electrode disposed in the cell box and spaced a distance from the anodic electrode for at least partial immersion in the electrolyte; and an electrical power source connected to the anodic electrode and to the cathodic electrode, the anodic electrode and the cathodic electrode being connected in electrical series; and wherein the bipolar electrode is disposed in the cell box and spaced generally between the anodic electrode and the cathodic electrode.

16. The bipolar electrode of claim 15 defined further to include:

means sealingly engaging portions of the anodic member and portions of the cell box and sealingly engaging portions of the cathodic member and portions of the cell box for substantially sealing electrolyte from passing around the bipolar electrode generally between the cell box and the bipolar electrode.

17. The bipolar electrode of claim 15 defined further to include:

an elastomeric seal member sealingly engaging portions of the anodic member, the cathodic member and the connector for substantially preventing electrolyte from contacting and for cooperating with the connector to substantially prevent electrolyte from entering the space between the anodic and the cathodic members.

18. The bipolar electrode of claim 17 wherein the cell box is defined further to include channels for slidingly receiving the bipolar electrode, the seal member sealingly engaging portions of the cell box for substantially sealing electrolyte from passing around the bipolar electrode between the seal member and the cell box.

19. The bipolar electrode of claim 1 wherein the anodic member comprises a titanium metal having a coating of a material forming an anodic surface on the first face of the anodic member.

20. The bipolar electrode of claim 19 wherein the material forming the anodic surface on the anodic member is defined further as being a noble metal selected from the group consisting of platinum, iridium, platinum-iridium, rubidium, ruthenium, osmium and oxides thereof.

* * * * *